US012140312B2

(12) United States Patent
Kim

(10) Patent No.: US 12,140,312 B2
(45) Date of Patent: Nov. 12, 2024

(54) GAS TURBINE COMBUSTOR INJECTOR ASSEMBLY COMPRISING AN AIR SUPPLY UNIT HAVING AN INCLINED SURFACE RELATIVE TO AN INCLINED INJECTION PIPE

(71) Applicant: DOOSAN ENERBILITY CO., LTD., Changwon (KR)

(72) Inventor: Hokeun Kim, Daejeon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/473,246

(22) Filed: Sep. 24, 2023

(65) Prior Publication Data

US 2024/0183538 A1 Jun. 6, 2024

(30) Foreign Application Priority Data

Dec. 6, 2022 (KR) ..... 10-2022-0169036

(51) Int. Cl.
*F23R 3/34* (2006.01)
*F23R 3/28* (2006.01)

(52) U.S. Cl.
CPC ..... *F23R 3/346* (2013.01); *F23R 3/286* (2013.01); *F23R 3/34* (2013.01)

(58) Field of Classification Search
CPC ..... F23R 3/34; F23R 3/36; F23R 3/346
See application file for complete search history.

(56) References Cited

U.S. PATENT DOCUMENTS

| | | | | |
|---|---|---|---|---|
| 4,192,139 | A | 3/1980 | Buchheim | |
| 11,067,281 | B1 * | 7/2021 | Garcia | F23R 3/283 |
| 11,566,790 | B1 * | 1/2023 | Hughes | F23R 3/36 |
| 2010/0229557 | A1 * | 9/2010 | Matsumoto | F23R 3/34 60/737 |
| 2011/0289928 | A1 * | 12/2011 | Fox | F23R 3/34 60/740 |
| 2011/0314824 | A1 * | 12/2011 | Cheung | F23R 3/286 60/737 |
| 2014/0260258 | A1 * | 9/2014 | Melton | F23R 3/26 60/758 |
| 2015/0285501 | A1 * | 10/2015 | DiCintio | F23R 3/346 60/740 |
| 2015/0362194 | A1 | 12/2015 | Ogata | |
| 2016/0209039 | A1 | 7/2016 | Cheung | |

(Continued)

FOREIGN PATENT DOCUMENTS

JP 4670035 A 1/2006

*Primary Examiner* — William H Rodriguez
(74) *Attorney, Agent, or Firm* — Harvest IP Law, LLP

(57) ABSTRACT

Proposed is a combustor that includes a liner provided with a combustion chamber at an inner side of which a mixture of fuel and compressed air is combusted, a transition piece connected to an end of the liner, a fluid-flowing sleeve disposed at an outer side of the liner and the transition piece, and at least one injector configured to inject the mixture of fuel and air by being disposed on the liner or the transition piece, wherein the injector includes an injection pipe connected to the liner or the transition piece, a fuel supply unit configured to supply the fuel from a center part of a rear end of the injection pipe, and an air supply unit configured to supply the air from an inner circumferential part of the rear end of the injection pipe.

14 Claims, 4 Drawing Sheets

(56) References Cited

U.S. PATENT DOCUMENTS

| | | | | |
|---|---|---|---|---|
| 2017/0219212 | A1* | 8/2017 | Laster | F02C 3/30 |
| 2017/0268784 | A1* | 9/2017 | Crawley | F23R 3/34 |
| 2017/0298817 | A1* | 10/2017 | Horiuchi | F02C 7/16 |
| 2017/0321609 | A1* | 11/2017 | Ogata | F02C 7/228 |
| 2017/0356656 | A1* | 12/2017 | Ogata | F23R 3/28 |
| 2019/0072279 | A1* | 3/2019 | Natarajan | F23R 3/002 |
| 2019/0162414 | A1* | 5/2019 | Ogata | F23R 3/286 |
| 2019/0178496 | A1* | 6/2019 | Jones | F23R 3/045 |
| 2019/0178498 | A1 | 6/2019 | Wilson | |
| 2019/0226680 | A1* | 7/2019 | North | F23R 3/34 |
| 2021/0199300 | A1* | 7/2021 | Berry | F23R 3/286 |
| 2022/0099297 | A1* | 3/2022 | Garcia | F23R 3/286 |
| 2022/0412563 | A1* | 12/2022 | Giridharan | F23R 3/346 |
| 2023/0243505 | A1* | 8/2023 | Joshi | F23R 3/50 60/39.461 |

* cited by examiner

GAS TURBINE COMBUSTOR INJECTOR ASSEMBLY COMPRISING AN AIR SUPPLY UNIT HAVING AN INCLINED SURFACE RELATIVE TO AN INCLINED INJECTION PIPE

CROSS REFERENCE TO RELATED APPLICATION

The present application claims priority to Korean Patent Application No. 10-2022-0169036, filed on Dec. 6, 2022, the entire contents of which are incorporated herein for all purposes by this reference.

BACKGROUND

1. Technical Field

An embodiment of the present disclosure relates to a combustor and a gas turbine including same and, more specifically, to a combustor provided with an injector and a gas turbine including same.

2. Description of the Background Art

In general, a turbine is a machine that converts energy of a fluid such as water, gas, steam, and the like into mechanical work. Usually, a turbo-type machine is referred as a turbine. In a turbo-type machine, a rotating body is equipped with multiple vanes or blades along its circumference. The rotating body achieves high speed rotation by impulsive force or reaction force generated by steam or gas that is directed onto those vanes or blades.

Types of such turbines include a water turbine using energy from water at a high place, a steam turbine using energy from steam, an air turbine using energy from high-pressure compressed air, a gas turbine using energy from high-temperature and high-pressure gas, and the like.

In general, a gas turbine is a type of internal combustion engine that converts thermal energy into mechanical energy. This conversion is accomplished by causing the turbine to rotate. This rotation is driven by injecting a high-temperature and high-pressure combustion gas into the turbine. The high-temperature and high-pressure combustion gas is generated by combusting the fuel mixed with compressed air that is compressed by a compressor.

Such a gas turbine does not have a reciprocating mechanism such as a piston of a 4-stroke engine, so there is no mutual friction part such as a piston-cylinder, thereby providing various advantages. The advantages include minimal consumption of lubricating oil, a significant reduction in amplitude (a characteristic of reciprocating machines), and a capability for high-speed movement.

A gas turbine includes, as fundamental components, a compressor configured to compress air, a combustor configured to generate combustion gas by combusting compressed air supplied from the compressor and the fuel, and a turbine configured to generate power by rotating blades through high-temperature and high-pressure gas produced from the combustor.

Among configurations of the gas turbine, the combustor injects the fuel into the compressed air from the compressor to mix the fuel and the compressed air so that the mixture is combusted in a combustion chamber. When supplying the fuel mixed with the compressed air to the combustion chamber, it is important to increase a degree of mixing of air and fuel. When the degree of mixing of the air and fuel is improved, combustion vibration during combustion in the combustion chamber is reduced, and thus power generation efficiency of the gas turbine as a whole is improved.

In addition, it is important to improve combustion efficiency as much as to improve the degree of mixing of the air and fuel. Increasing the combustion efficiency ultimately means that the fuel and the air are mixed and combusted to the maximum extent to be used as energy. However, when a ratio of the fuel and the air is not appropriate, complete combustion is not achieved, resulting in a decrease in the combustion efficiency.

The foregoing is intended merely to aid in the understanding of the background of the present disclosure, and is not intended to mean that the present disclosure falls within the purview of the related art that is already known to those skilled in the art.

SUMMARY

Accordingly, the present disclosure has been made keeping in mind the above problems occurring in the related art. One of objectives of the present disclosure is to expand a low load operating range of a combustor of a gas turbine to minimize generation of NOx.

Problems to be solved by the present disclosure are not limited to the above-mentioned problems, and other problems not mentioned herein will be able to be clearly understood by those skilled in the art from the following description.

In order to achieve the above objective, according to the present disclosure, there may be provided a combustor including: a liner provided with a combustion chamber at an inner side where a mixture of fuel and air is combusted; a transition piece connected to an end of the liner; a fluid-flowing sleeve disposed at an outer side of the liner and the transition piece; and at least one injector disposed on the liner or the transition piece and configured to inject the mixture of the fuel and the air, wherein the injector may include: an injection pipe connected to the liner or the transition piece; a fuel supply unit configured to supply the fuel from a center part of a rear end of the injection pipe; and an air supply unit configured to supply the air from an inner circumferential part of the rear end of the injection pipe, wherein an outlet area is formed at a front end of the air supply unit, which is configured to guide a direction of the air to be directed toward a center of the injection pipe.

The outlet area of the air supply unit may be provided to have an inclined surface inclined radially inward.

The injection pipe may be provided to be inclined radially inward.

An inclined angle of the injection pipe may be provided to be smaller than an inclined angle of the inclined surface of the outlet area.

The air supply unit may be connected to a rear end of the injection pipe and configured to inject the air so that the air moves along an inner wall of the injection pipe.

The air supply unit may be provided in an annular shape.

The injection pipe may be disposed to penetrate through the liner and the fluid-flowing sleeve or the transition piece and the fluid-flowing sleeve.

A length of the air supply unit may be provided to be longer than a length of the fuel supply unit.

The fuel supply unit may be provided in a pipe structure with a closed are at one end, and in the closed area, at least one fuel supply hole is provided so that the fuel is injected in a direction the air is supplied from the air supply unit.

In addition, according to the present disclosure, there may be provided a gas turbine including: a compressor configured to compress air introduced from an outside; a combustor configured to combust the mixture of fuel and the air compressed by the compressor; and a turbine configured to generate power for power generation using combustion gas supplied from the combustor; wherein the combustor may include: a liner provided with a combustion chamber at an inner side where the mixture of the fuel and the air is combusted; a transition piece connected to an end of the liner; a fluid-flowing sleeve disposed at an outer side of the liner and the transition piece; and at least one injector disposed on the liner or the transition piece and configured to inject the mixture of the fuel and the air, wherein the injector may include: an injection pipe connected to the liner or the transition piece; a fuel supply unit configured to supply the fuel from a center part of a rear end of the injection pipe; and an air supply unit configured to supply the air from an inner circumferential part of the rear end of the injection pipe, wherein an outlet area is formed at a front end of the air supply unit, which is configured to guide a direction of the air to be directed toward a center of the injection pipe.

As described above, according to the embodiment of the present disclosure, there is an effect of expanding a low load range of a combustor of a gas turbine and minimizing generation of NOx therethrough.

Various beneficial advantages and effects of the present disclosure are not limited to the above description and will be more easily understood in the process of describing specific embodiments of the present disclosure.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
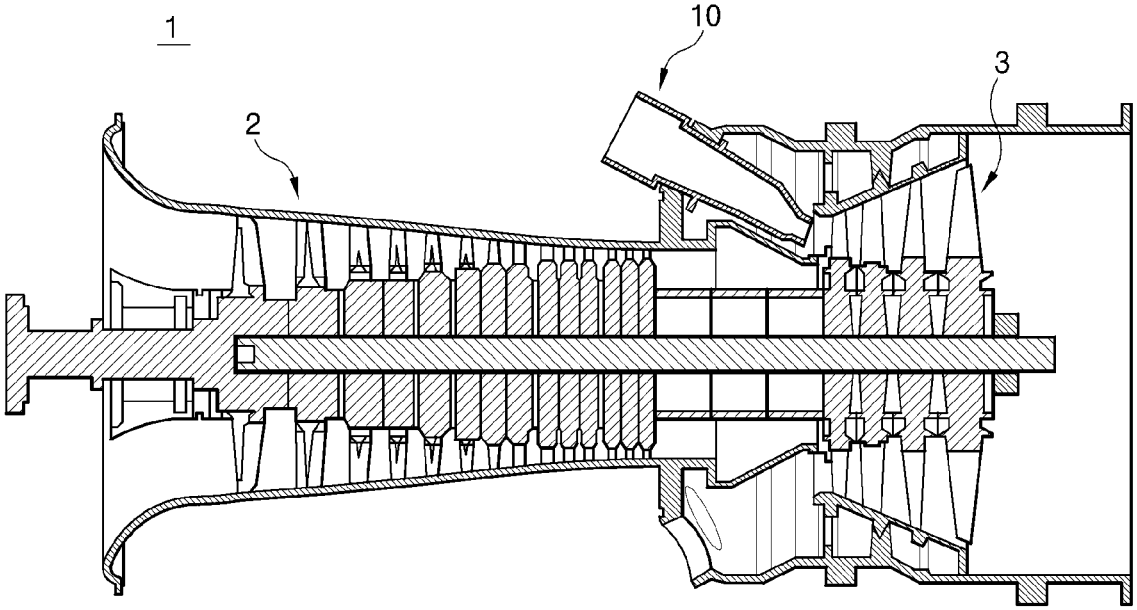
FIG. 1 is a sectional view showing a gas turbine according to the present disclosure.

Hereinafter, exemplary embodiments according to the present disclosure will be described in detail with reference to the accompanying drawings.

However, the technical idea of the present disclosure is not limited to some of embodiments to be described but may be implemented in a variety of different forms. When the embodiments are within the scope of the technical idea of the present disclosure, one or more of the components among the embodiments may be used by being selectively combined with and substituted for one another.

In addition, unless explicitly defined, terms (including technical and scientific terms) used in the embodiments of the present disclosure may be interpreted as having meanings generally understood by those of ordinary skill in the art to which the present disclosure belongs. Also, terms commonly used, such as terms defined in a dictionary, may be interpreted to have a meaning in consideration of contextual meanings of related technology.

In addition, the terms used in the embodiments of the present disclosure are for describing the embodiments and are not intended to limit the present disclosure.

In the present specification, a singular form may also include a plural form unless otherwise specified in a phrase, and when described as "at least one (or equal to or more than one) of A, B, and C", one or more of all possible combinations of A, B, and C may be included.

In addition, terms such as first, second, A, B, (a), (b), and the like may be used in describing different components of the embodiment of the present disclosure, but they do not necessarily limit the order or sequences of the relevant elements or components.

Such terms are only used to distinguish a component from other components, and the nature, turns, orders, or the like of the corresponding components are not limited by the terms.

In addition, when a component is described as being "connected", "coupled", or "linked" to another component, it may include not only a case in which the component is directly "connected", "coupled", or "linked" to another component but also a case in which the component is "connected", "coupled", or "linked" to the another component indirectly due to still another component present between the component and the another component.

In addition, when a component is described as being provided or disposed "on (at a top side of) or beneath (at a lower side of)" another component, it may include not only a case in which one component is in direct contact with another component on or beneath another component but also a case in which two components are in contact with each other via one or more other components provided or disposed therebetween unless the context clearly indicates otherwise. In addition, when expressed as "on (at a top side of) or beneath (at a lower side of)" one component, it may have a meaning of including an upward direction, or a downward direction based on the one component.

Hereinafter, the embodiment will be described in detail with reference to the accompanying drawings, wherein the same or corresponding components regardless of reference numerals are given the same reference numerals, and overlapping descriptions thereof will be omitted.

Figure 2:
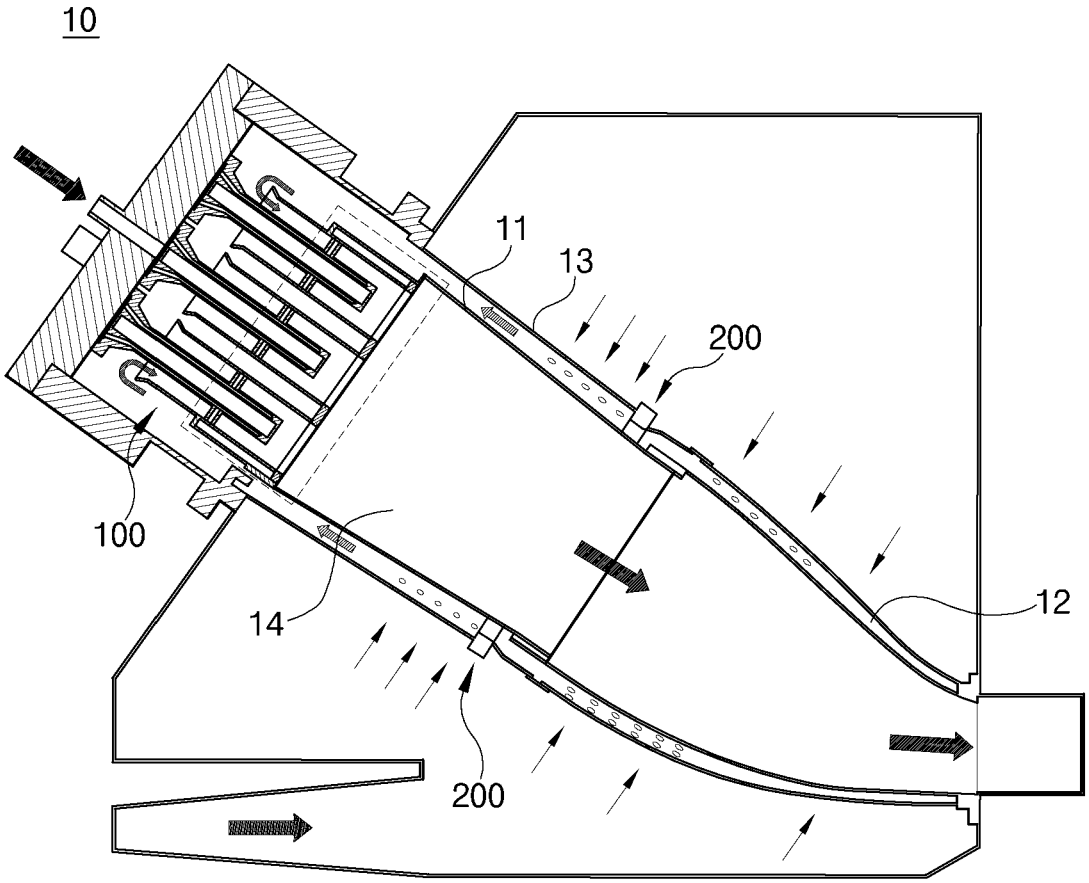
FIG. 2 is a sectional view of a combustor shown in FIG. 1.
Figure 3:
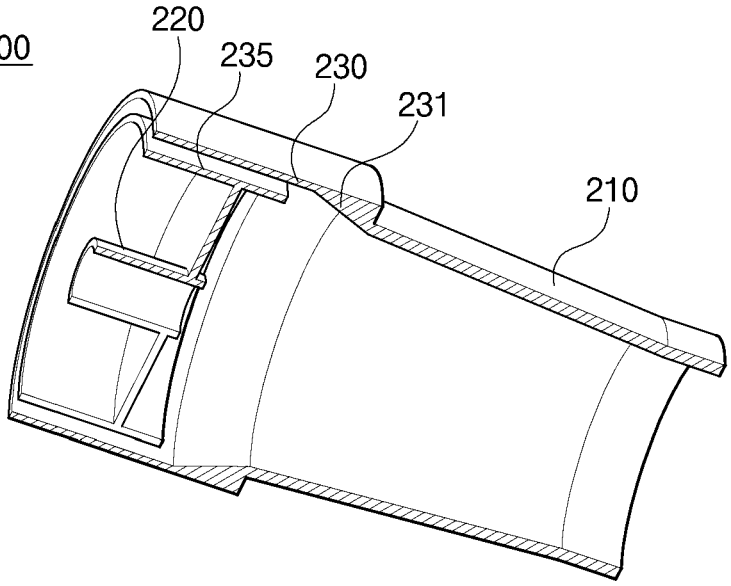
FIG. 3 is a view showing an injector, which is a component in FIG. 2.
Figure 4:
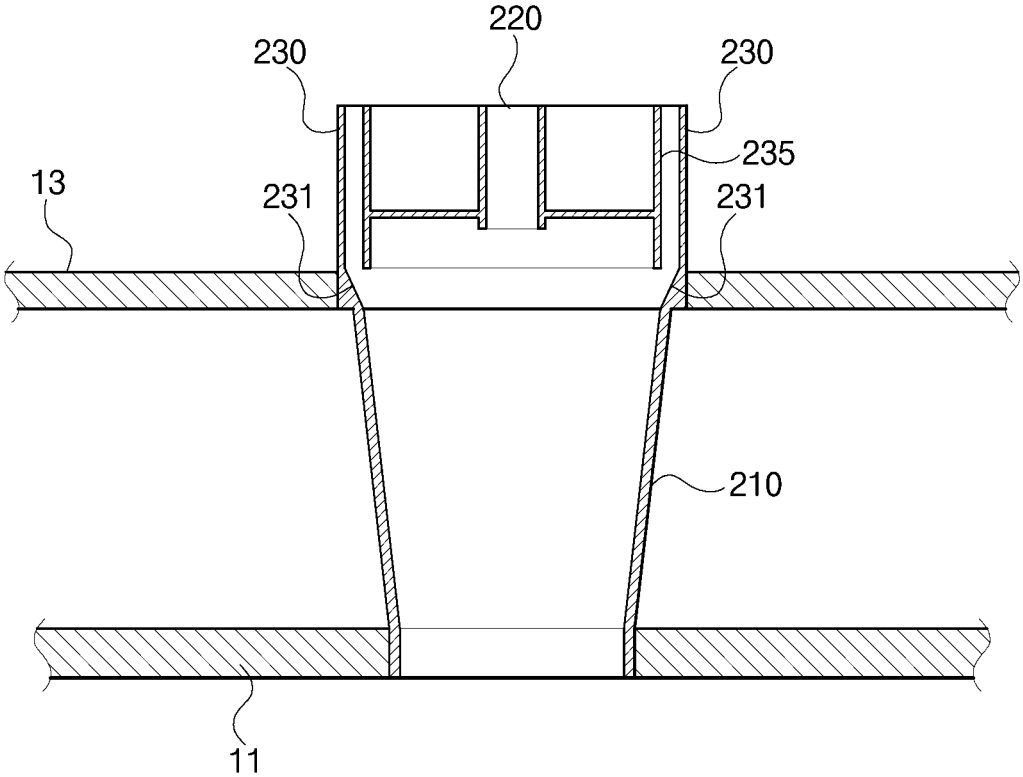
FIG. 4 is a view showing an arrangement structure of the injector in FIG. 3.

FIG. 1 is a sectional view showing a gas turbine according to the present disclosure, FIG. 2 is a sectional view of a combustor shown in FIG. 1, FIG. 3 is a view showing an injector, which is a component in FIG. 2, and FIG. 4 is a view showing an arrangement structure of the injector in FIG. 3.

FIGS. 1 to 4 show only the main features to ensure a clear conceptual understanding of the present disclosure. Therefore, as a result, various modifications of the diagram are expected, and the scope of the present disclosure is not limited by the specific shapes shown in the drawings.

With reference to FIG. 1, a gas turbine 1 according to the present disclosure includes a compressor 2, a combustor 10, and a turbine 3. On the basis of a flow direction of gas (compressed air or combustion gas), the compressor 2 is disposed on an upstream side of the gas turbine 1, and the turbine 3 is disposed on a downstream side of the gas turbine 1. In addition, the combustor 10 is disposed between the compressor 2 and the turbine 3.

The compressor 2 accommodates compressor vanes and a compressor rotor inside a compressor casing, and the turbine 3 accommodates turbine vanes and a turbine rotor inside a turbine casing. Such compressor vanes and the compressor rotor are arranged in multi-stages along a flow direction of compressed air, and the turbine vanes and turbine rotor are also arranged in multi-stages along the flow direction of combustion gas. At this time, an internal space of the compressor 2 is designed in a structure to gradually decrease from a front-stage to a rear-stage so that intake air may be compressed, and on the contrary, an internal space of the turbine 3 is designed in a structure to gradually increase from a front-stage to a rear-stage so that the combustion gas supplied from the combustor may expand.

On the other hand, between the compressor rotor located at a rear end of the compressor 2 and the turbine rotor located at a front end of the turbine 3, a torque tube is disposed, as a torque transmission member, and transmit a rotational torque generated in the turbine 3 to the compressor 2. As shown in FIG. 1, the torque tube may be composed of a plurality of torque tube disks having a total of three stages, but this is only one of several embodiments of the present disclosure. In other words, the torque tube may be composed of a plurality of torque tube disks having more than or less than three stages.

The compressor rotor includes a compressor disk and compressor blades. A plurality of compressor disks (for example, 14 sheets or stages) may be provided inside the compressor casing. Each of the compressor disks is securely fastened by a tie rod so as not to be spaced apart from one another along an axial direction. More specifically, the compressor disks are aligned in an axial arrangement where the tie rod penetrates through the central part of each of the disks. In addition, compressor disks adjacent to each other are arranged such that opposing surfaces are compressed by the tie rod so as not to relatively rotate to each other.

A plurality of compressor blades is radially coupled to an outer circumferential surface of each of the compressor disks. In addition, on the basis of the same stage, a plurality of compressor vanes that are positioned in an annual fashion along an inner circumferential surface of the compressor casing before the combustion gas reaching the compressor blades of the same stage. The compressor vanes are designed, differently from the compressor disks, to remain stationary so as not to rotate. The compressor vanes serve to guide the compressed air to the downstream compressor blades positioned downstream by aligning a flow of the compressed air that passes through the compressor blades. In this case, the compressor casing and the compressor vanes may collectively be referred to a compressor stator to distinguish it from the compressor rotor.

The tie rod is disposed to penetrate through the center of turbine disks to be described later and the plurality of compressor disks and has one end fastened to the compressor disk located at the front end of the compressor and an opposite end fastened with a fixing nut.

A shape of the tie rod may be provided in various structures depending on the gas turbine, so it is not necessarily limited to the shape shown in FIG. 1. That is, the tie rod may have a different shape such as a shape having one tie rod penetrating the center of the compressor disks and the turbine disks as show in FIG. 1, a shape having a plurality of tie rods arranged on a circumference of each of the compressor disks and the turbine disks, or a shape having rods in a combination of the two above.

Although not shown, a deswirler, which acts as a guide vane, may be installed in the compressor of the gas turbine in order to adjust a flow angle of a fluid as it enters an inlet of the combustor to match the intended design flow angle after the pressure of the fluid has been raised.

With reference to FIG. 2, the combustor 10 includes a liner 11, which houses a combustion chamber 14 where a mixture of the compressed air, compressed by the compressor 2, and fuel is combusted. Connected to one end of the liner 11 is a transition piece 12, which guides the resulting combustion gas to the turbine 3. Here, the liner 11 is provided with a combustion chamber 14 therein, and a fluid-flowing sleeve 13 is disposed at an outer side of the liner 11 and the transition piece 12 so as to surround the liner 11 and the transition piece 12. The fluid-flowing sleeve 13 provides an annular shape flow space between the fluid-flowing sleeve 13, and the liner 11 and the transition piece 12.

In addition, the combustor 10 is provided with a nozzle assembly 100, one of several nozzle assemblies for a plurality of the combustors 10, configured to mix the compressed air supplied from the compressor 2 with the fuel. The nozzle assembly 100 is coupled to the front of the liner 11.

An end plate is coupled to the front of the fluid-flowing sleeve 13. This the end plate serves to support the nozzle assembly 100 and provides sealing for the combustor 10.

Accordingly, the compressed air (used for combustion) can be introduced into an annular flow path between the liner 11 and the fluid-flowing sleeve 13 through a plurality of flow holes provided in the fluid-flowing sleeve. These flow holes connect to an accommodation space where the compressed air, discharged from the compressor 2 and confined by the casing of the combustor 10, is stored.

As described above, the compressed air introduced into the annular flow path between the liner 11 and the fluid-flowing sleeve 13 flows forward in the combustor 10, reaches the end plate, then is converted into an opposite direction, and is supplied to the nozzle assembly 100. That is, the compressed air introduced from the compressor 2 is injected into the combustion chamber 14 where it mixed with the fuel via the nozzle assembly 100. Then, the mixture of the compressed air and the fuel is ignited by a spark plug (not shown), resulting in combustion within the combustion chamber 14.

According to an embodiment, the liner 11 may at least partially confine a primary combustion section for combusting a first fuel/air mixture injected by the nozzle assembly 100 and may be possible to confine a secondary combustion section provided downstream from the primary combustion section in an axial direction of the combustor 10.

The combustor 10 may further include an injector 200 for injecting a second fuel/air mixture into the secondary combustion section, which corresponds to a subsequent stage in the axial direction after the primary combustion section according to the flow direction of the combustion gas.

The injector 200 is disposed downstream of the nozzle assembly 100 and upstream of the turbine 3 according to the flow direction of the combustion gas in the axial direction of the combustor 10, and a plurality of injectors 200 may be used in a single combustor 10. In the present embodiment, the injector 200 is disposed at a rear end of the liner 11, but is not limited thereto, and may be of course disposed at the front or rear end of the transition piece 12.

The plurality of injectors 200 is disposed by being spaced apart along a circumferential direction of the liner 11. According to an embodiment, as shown in the present embodiment of FIG. 2, the plurality of injectors 200 may be provided on a single plane perpendicular to the axial direction of the combustor 10 but is not limited thereto. In other words, the plurality of injectors 200 may be provided on a plurality of planes of at least two that are spaced apart to be perpendicular to the axial direction of the combustor 10. The injector 200 may extend radially through the liner 11 and the fluid-flowing sleeve 13, thereby providing fluid communication between the accommodation space and the combustion chamber 14. That is, the injector 200 may be provided to extend in a direction across the flow of compressed air inside the annular flow path.

A portion of the compressed air discharged from the compressor 2 and accommodated in the accommodation space may be introduced into the injector 200, mixed with fuel, and then injected into the combustion chamber 14, more specifically, into the secondary combustion section. The second fuel/air mixture injected by the injector 200 may be mixed with the high-temperature combustion gas, which previously has been combusted in the primary combustion section. The injector 200 will be described in detail below.

Meanwhile, with reference to FIG. 1 again, the high-temperature and high-pressure combustion gas supplied from the combustor 10 is supplied to the turbine 3 described above. The high-temperature and high-pressure combustion gas supplied to the turbine 3 expands while passing through the inside of the turbine 3. Accordingly, the combustion gas applies impulse and reaction force to blades of the turbine 3, which will be described later so that rotational torque is generated. The rotational torque obtained in this way is transmitted to the compressor 2 through the aforementioned torque tube, and a portion exceeding the power required to drive the compressor 2 is used to drive a generator or the like.

The turbine 3 is fundamentally similar to the structure of the compressor 2. That is, similar to the compressor 2, the turbine includes a plurality of turbine rotors similar to the compressor rotors of the compressor 2. Accordingly, the turbine rotor also includes a turbine disk and a plurality of turbine blades radially disposed therefrom. On the basis of the same stage, a plurality of turbine vanes that are positioned in an annular fashion along an inner circumferential surface of the turbine casing before the combustion gas reaching the turbine blades of the same stage. The turbine vanes guide a flow direction of the combustion gas that passes through the downstream turbine blades. In this case, the turbine casing and the turbine vanes may collectively be referred to as a turbine stator to distinguish it from the turbine rotor.

With reference to FIGS. 3 and 4, the injector 200 may be disposed in the liner 11 or the transition piece 12, thereby injecting the mixture of fuel and compressed air into the combustion chamber 14. The injector 200 may include an injection pipe 210, a fuel supply unit 220, and an air supply unit 230.

The injector 200 may be generally in a cylindrical shape or in a circular pipe structure elongated along a central axis. According to an embodiment, the injection pipe 210, the fuel supply unit 220, and an air supply unit 230 may be concentric and share the central axis previously described. According to the flow direction of the fuel/air mixture in the injector 200, the upstream side and the upstream end may be referred to as the upper side and the upper end or the rear side and the rear end. Similar, the downstream side and the downstream end may be referred to as the lower side and the lower end or the front side and the front end. An outlet is formed at the lower end of the injector 200. The direction toward the upstream side may be referred to as the upward side and the direction toward the downstream side may be referred to as the downward side.

The injection pipe 210 is connected, at its lower end, to the liner 11 or the transition piece 12 and provides an inner space in which the fuel and compressed air are mixed with each other. The injection pipe 210 may be provided to have an inclination. The upper end of the injection pipe 210 may be connected to the fuel supply unit 220 and the air supply unit 230, and its lower end may be connected to the combustion chamber 14.

According to an embodiment, the injection pipe 210 may have a structure in which a diameter of a cross section of a side wall decreases toward the outlet. In other words, the inner diameter of the injection pipe 210 may decrease from its upper end to its lower end. Also, the injection pipe 210 may be described as having a tapered shape. To ensure effective mixing in the combustion chamber 14, the injection pipe 210 is designed with the tapered shape, gradually decreasing in diameter towards the outlet. This design increases the penetration distance of the fuel/air mixture into the combustion chamber 14, facilitating better mixing, within the combustion chamber 14, between the primary combustion product and the fuel/air mixture from the injection pipe 210. By this design, the velocity of the fuel/air mixture injected into the combustion section from the injector 200 may be increased, effectively preventing flashback caused by combustion products from the primary combustion section.

The injection pipe 210 may be disposed to penetrate through the liner 11 and the fluid-flowing sleeve 13, or the transition piece 12 and the fluid-flowing sleeve 13. As mentioned above, the injection pipe 210 may be disposed on a side of either the liner 11 and the transition piece 12, and the sidewall of the injection pipe 210 may be disposed in the flow path of the compressed air flowing along and between the liner 11 and the fluid-flowing sleeve 13 or between the transition piece and the fluid-flowing sleeve 13. With such an arrangement structure, the compressed air may have an effect of cooling the sidewall of the injection pipe 210.

The fuel supply unit 220 may supply the fuel toward the injection pipe 210. The fuel from the fuel supply unit 220 is injected into a center part of the rear end of the injection pipe 210. According to an embodiment, the lower end of the fuel supply unit 220 may be located relatively upward than the upper end of the injection pipe. The fuel supplied from the fuel supply unit 220 is not limited, and any known fuels such as hydrogen and others suitable for operating the turbine 3 may be used.

According to an embodiment, the fuel supply unit 220 may be disposed to share a central axis of the injection pipe 210 in a cylindrical structure.

The air supply unit 230 may be disposed at an upper side of the injector 200, being connected to the rear end of the injection pipe 210 to supply the compressed air toward the injection pipe 210. At this time, the outlet area 231 of the air supply unit 230, which is formed at the lower end of the air supply unit 230 may guide the direction of the discharged air to be directed to and flow toward a center part of the injection pipe 210.

As one embodiment, the air supply unit 230 may be provided in an annular structure having a constant width from its upper end to the lower end. However, the air supply unit 230 is not limited to such an annular structure and may have a structure in which a plurality of tubes is connected to the rear end of the injection tube 210.

The air supply unit 230 may be disposed to be spaced apart from the fuel supply unit 220. At this time, the air supply unit 230 provided in the annular band-shaped structure may be disposed to be spaced apart with an equal interval from the center of the fuel supply unit 220. More specifically, the air supply unit 230 may be provided with an inner annular wall 235 sharing the same central axis with the air supply unit 230. The outer-diameter of the inner annular wall 235 may be smaller than the inner-diameter of the inner surface of the air supply unit 230, such that the inner annular wall 235 and the inner surface of the air supply unit 230 form a flow path therebetween for the compressed air to flow through toward the injection pipe 210. A mixing rate of the fuel supplied form the fuel supply unit 220 and the air supplied from the air supply unit 230 may be increased due to a diffusion effect through a separation distance between them at the location where they are discharged from the fuel supply unit 220 and the air supply unit 230, respectively.

While the fuel is injected from the fuel supply unit 220 disposed at the center, the air discharged from the air supply unit 230, which is disposed at a predetermined distance in the radial direction of the fuel supply unit 220, is discharged to be directed to and to flow toward the center part of the injection pipe 210 due to the outlet area of the air supply unit 230, thereby being allowed to be mixed with the fuel discharged from the fuel supply unit 220 at a fast speed.

The outlet area 231 of the air supply unit 230 may be provided at the lower end of the air supply unit 230 with an inclined surface radially inwardly and may be connected to the rear end of the injection pipe 210. In this case, an angle of inclination of the injection pipe 210 may be provided to be smaller than an angle of inclination of the inclined surface of the outlet area 231. In other words, the outlet area 231 is inclined radially inward more than the injection pipe 210.

The air discharged from the air supply unit 230 is discharged along the inclined surface of the outlet area 231 (i.e., flowing radially inward) and mixed with the fuel discharged from the fuel supply unit 220. At the same time, a portion of the air discharged from the air supply unit 230 serves to cool an inner wall of the injection pipe 210 while moving along the inner wall of the injection pipe 210 after flowing along the inclined surface of the outlet area 231. The inner and outer walls of such an injection pipe 210 may be cooled by the compressed air by the portion of the air discharged from the air supply unit 230.

At this time, a pipe length of the air supply unit 230 in the direction of the central axis may be provided to be longer than that of the fuel supply unit 220. The pipe length of the air supply unit 230 may refer to the length between the upper end and the lower end of the inner annular wall 235 or the length between the upper end of the air supply unit 230 and the upper end of the outlet area 231. This is to increase a speed of the air supplied through the air supply unit 230 and to facilitate the introduced air to move along the outlet area 231 and then easily move by riding on the inner wall of the injection pipe 210.

According to the present disclosure, combustion takes place in the primary combustion section of the combustor 10, and at the same time, the mixture of the fuel and air may be directly injected into the secondary combustion section of the combustor 10 located downstream of the primary combustion section through the injector 200. This design allows to reduce the emission of nitrogen oxides (NOx) from the gas turbine 1.

Figure 5:
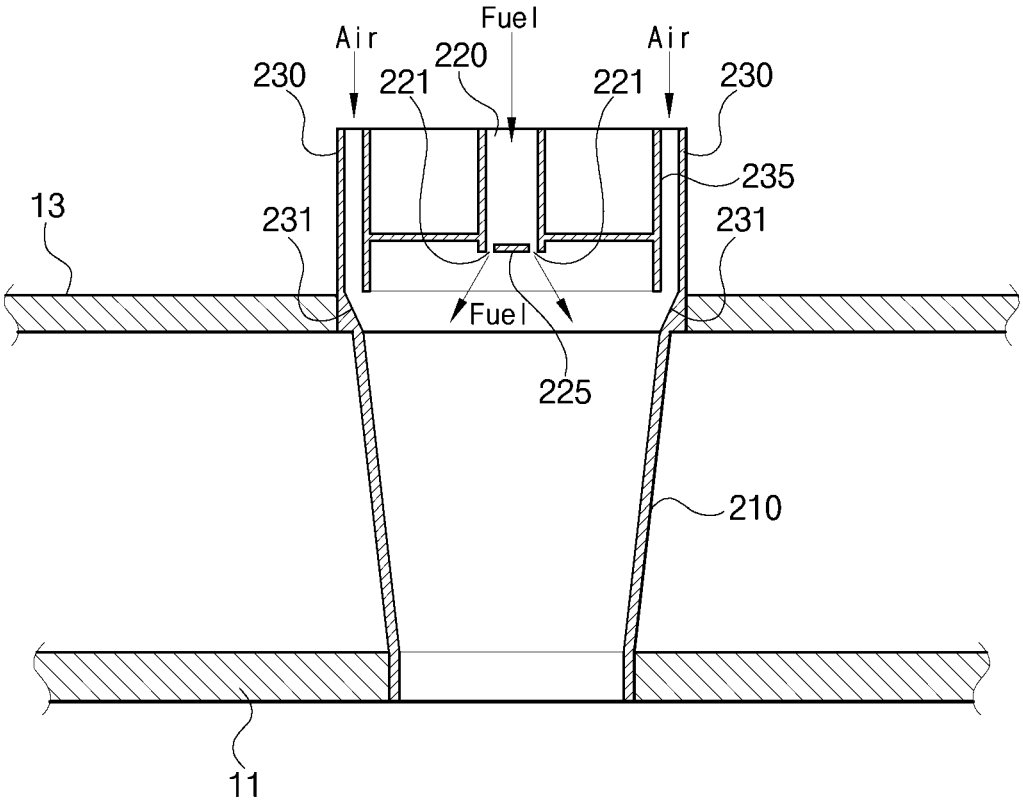
FIG. 5 is a view showing an embodiment of the injector that is a component in FIG. 2.

With reference to FIG. 5, according to an embodiment, the fuel supply unit 220 is provided with a pipe structure with a closed lower end, which may be referred to as a closed area 225. In the closed area 225, at least one fuel supply hole 221 is provided so that the fuel is injected toward the injection pipe 210.

A shape of the fuel supply hole 221 is not limited, but may be provided with a plurality of holes for even mixing with the air discharged from the air supply unit 230. The fuel supply hole 221 may be arranged at regular intervals in a circumferential direction along the periphery of the closed area 225.

The fuel supplied from the fuel supply hole 221 may be injected inclined radially outward to be directed toward the air discharged from the air supply unit 230, thereby increasing the mixing rate.

According to an embodiment, the fuel supply hole 221 may be disposed to be inclined radially outward, thereby guiding the movement of injected fuel.

In the above, the embodiments of the present disclosure have been described in detail with reference to the accompanying drawings.

The above description is merely an example of the technical idea of the present disclosure, and those skilled in the art will be able to make various modifications, changes, and substitutions for the description without departing from the essential characteristics of the present disclosure. Therefore, the embodiments disclosed in the present disclosure and the accompanying drawings are not intended to limit the technical idea of the present disclosure but to explain, and the scope of the technical idea of the present disclosure is not limited by such embodiments and the accompanying drawings. Also, it is noted that any one feature of an embodiment of the present disclosure described in the specification may be applied to another embodiment of the present disclosure. The protection scope of the present disclosure should be construed according to the following claims, and all technical ideas within the equivalent range thereto should be construed as being included in the scope of the present disclosure.

The invention claimed is:

1. A combustor comprising:

a liner provided with a combustion chamber at an inner side where a mixture of fuel and air is combusted;

a transition piece connected to an end of the liner;

a fluid-flowing sleeve disposed at an outer side of the liner and the transition piece; and at least one injector disposed on the liner or the transition piece and configured to inject the mixture of the fuel and the air, wherein the injector includes:

an injection pipe connected to the liner or the transition piece;

a fuel supply unit configured to supply the fuel from a center part of a rear end of the injection pipe; and an air supply unit configured to supply the air from an inner circumferential part of the rear end of the injection pipe, wherein an outlet area is formed at a front end of the air supply unit, which is configured to guide a direction of the air to be directed toward a center of the injection pipe, wherein the outlet area of the air supply unit is provided to have an inclined surface inclined radially inward, wherein the injection pipe is provided to be inclined radially inward, wherein an inclined angle of the injection pipe is provided to be smaller than an inclined angle of the inclined surface of the outlet area.

2. The combustor of claim 1, wherein the air supply unit is connected to a rear end of the injection pipe and configured to inject the air so that the air moves along an inner wall of the injection pipe.

3. The combustor of claim 2, wherein the air supply unit is provided in an annular shape.

4. The combustor of claim 1, wherein the injection pipe is disposed to penetrate through the liner and the fluid-flowing sleeve or the transition piece and the fluid-flowing sleeve.

5. The combustor of claim 1, wherein a length of the air supply unit is provided to be longer than a length of the fuel supply unit.

6. The combustor of claim 1, wherein the fuel supply unit is provided in a pipe structure with a closed area at one end, and in the closed area, at least one fuel supply hole is provided so that the fuel is injected in a direction the air is supplied from the air supply unit.

7. The combustor of claim 6, wherein the closed are includes an end plate closing the one end of the fuel supply unit, the end plate is perpendicular to an elongated direction of the fuel supply unit, wherein the least one fuel supply hole is formed on the end plate.

8. A gas turbine comprising:

a compressor configured to compress air introduced from an outside;

a combustor configured to combust the mixture of fuel and the air compressed by the compressor; and a turbine configured to generate power for power generation using the combustion gas supplied from the combustor;

wherein the combustor includes:

a liner provided with a combustion chamber at an inner side where the mixture of the fuel and the air is combusted;

a transition piece connected to an end of the liner;

a fluid-flowing sleeve disposed at an outer side of the liner and the transition piece; and at least one injector disposed on the liner or the transition piece and configured to inject the mixture of the fuel and the air, wherein the injector includes:

an injection pipe connected to the liner or the transition piece;

a fuel supply unit configured to supply the fuel from a center part of a rear end of the injection pipe; and an air supply unit configured to supply the air from an inner circumferential part of the rear end of the injection pipe, wherein an outlet area is formed at a front end of the air supply unit, which is configured to guide a direction of the air to be directed toward a center of the injection pipe, wherein the outlet area of the air supply unit is provided to have an inclined surface inclined radially inward, wherein the injection pipe is provided to be inclined radially inward, wherein an inclined angle of the injection pipe is provided to be smaller than an inclined angle of the inclined surface of the outlet area.

9. The gas turbine of claim 8, wherein the air supply unit is connected to a rear end of the injection pipe and configured to inject the air so that the air moves along an inner wall of the injection pipe.

10. The gas turbine of claim 9, wherein the air supply unit is provided in an annular shape.

11. The gas turbine of claim 8, wherein the injection pipe is disposed to penetrate through the liner and the fluid-flowing sleeve or the transition piece and the fluid-flowing sleeve.

12. The gas turbine of claim 8, wherein a length of the air supply unit is provided to be longer than a length of the fuel supply unit.

13. The gas turbine of claim 8, wherein the fuel supply unit is provided in a pipe structure with a closed area at one end, and in the closed area, at least one fuel supply hole is provided so that the fuel is injected in a direction the air is supplied from the air supply unit.

14. The gas turbine of claim 13, wherein the closed are includes an end plate closing the one end of the fuel supply unit, the end plate is perpendicular to an elongated direction of the fuel supply unit, wherein the least one fuel supply hole is formed on the end plate.

* * * * *